US009096981B2

(12) United States Patent
Wians et al.

(10) Patent No.: US 9,096,981 B2
(45) Date of Patent: Aug. 4, 2015

(54) SNOWBLOWER ADJUSTABLE DEFLECTOR CONTROL DEVICES, SYSTEMS, AND METHODS

(71) Applicant: Honda Motor Co., Ltd., Tokyo (JP)

(72) Inventors: Jeffrey A. Wians, Mebane, NC (US); Dean E. Hartley, Burlington, NC (US)

(73) Assignee: Honda Motor Co., Ltd., Tokyo (JP)

( * ) Notice: Subject to any disclaimer, the term of this patent is extended or adjusted under 35 U.S.C. 154(b) by 137 days.

(21) Appl. No.: 13/760,789

(22) Filed: Feb. 6, 2013

(65) Prior Publication Data

US 2014/0215863 A1 Aug. 7, 2014

(51) Int. Cl.
*E01H 5/04* (2006.01)

(52) U.S. Cl.
CPC ..... *E01H 5/045* (2013.01)

(58) Field of Classification Search
CPC ..... E01H 5/045; B62D 51/04; B62D 51/001
USPC ..... 37/253, 256, 259, 266
See application file for complete search history.

(56) References Cited

U.S. PATENT DOCUMENTS

| | | | | |
|---|---|---|---|---|
| 2,642,680 | A | 6/1953 | Curtis et al. | |
| 3,349,877 | A * | 10/1967 | Downs | 477/8 |
| 3,510,171 | A | 5/1970 | Bacon | |
| 4,011,668 | A | 3/1977 | Gunderson | |
| 4,130,952 | A * | 12/1978 | Dion | 37/241 |
| 4,205,468 | A | 6/1980 | Greider | |
| 4,255,881 | A | 3/1981 | Fralish | |
| 4,862,607 | A | 9/1989 | Wacker | |
| 5,927,055 | A | 7/1999 | Ferree et al. | |
| 6,662,477 | B2 * | 12/2003 | Dowe et al. | 37/257 |
| 7,032,333 | B2 | 4/2006 | Friberg et al. | |
| 7,194,827 | B2 | 3/2007 | Mercer et al. | |
| 7,600,363 | B2 | 10/2009 | Porter et al. | |
| 7,624,521 | B2 * | 12/2009 | White et al. | 37/260 |
| 2004/0255493 | A1 * | 12/2004 | Friberg et al. | 37/260 |
| 2006/0096134 | A1 * | 5/2006 | Mercer et al. | 37/244 |
| 2008/0209771 | A1 * | 9/2008 | Jerger et al. | 37/260 |
| 2011/0094129 | A1 * | 4/2011 | Rowe et al. | 37/246 |
| 2011/0314707 | A1 * | 12/2011 | Raftery | 37/224 |
| 2012/0180346 | A1 * | 7/2012 | Gerrits et al. | 37/251 |

OTHER PUBLICATIONS

"How to Pick the Perfect Consumer 2-stage Snow Blower" snowblower direct http://www.snowblowersdirect.com/stories/149-How-to-Pick-the-Perfect-Consumer-2-Stage-Snow-Blower.html. (Accessed: Aug. 8, 2012).

"924050 remote deflector retrofit" www.abbysguide.com http://www.abbysguide.com/ope/discussions/62984-0-1.html (Accessed: Aug. 8, 2012).

* cited by examiner

*Primary Examiner* — Jamie L McGowan
(74) *Attorney, Agent, or Firm* — Jenkins, Wilson, Taylor & Hunt, P.A.

(57) ABSTRACT

Snowblower adjustable deflector control devices, systems, and methods can include a control cable connected at one end to a movable deflector of a discharge chute of a snowblower, a control lever pivotably connected to a machine handle of the snowblower, and a lever guide connected to the machine handle. The control lever can have a first end comprising a grip portion, a second end connected to the control cable, and at least one protrusion extending from the control lever, and the lever guide can be configured to selectively retain the at least one protrusion in any of one or more angular positions corresponding to one or more deflector positions.

19 Claims, 5 Drawing Sheets

SNOWBLOWER ADJUSTABLE DEFLECTOR CONTROL DEVICES, SYSTEMS, AND METHODS

BACKGROUND

Snowblowers are known having upright chutes through which a snow stream can be thrown. It is common for the chute to be designed such that it can be rotated from one side to the other to direct where the snow stream is deposited laterally relative to the snowblower. In addition, most snowblowers having rotatable chutes also usually have a pivotal deflector on the top of the chute. The angle of inclination of the deflector on the chute can be adjusted to control the trajectory of the snow stream.

For example, a common configuration for such an adjustable deflector is shown in FIG. 1. In this configuration, a movable deflector D is connected to a discharge chute DS at a hinged connection H. A deflector position control 10 is integrally connected to deflector D. Deflector position control 10 is provided with a handle 12 such that the user can grab the handle to manually move the deflector to a desired angular position. This system is generally designed such that the friction between deflector D and discharge chute DS is strong enough to retain deflector D in the desired position.

Such a configuration can lead to a variety of operation problems, however, depending on the specific implementation. If deflector position control 10 is relatively short, a user may be required to come around from the usual operating position behind the handle of the snowblower to one side of the snowblower in order to be near to deflector D to be able to reach handle 12 of deflector position control 10. Alternatively, if deflector position control 10 is long enough that the user can manipulate it while still behind the handle of the snowblower, the long length of such a simple mechanism can suffer from a lack of precise control over the position of deflector D, and the associated weight can make it difficult to maintain deflector D in the desired angular position.

In yet a further alternative, other configurations for an adjustable deflector can include a control handle that can be provided on the handle of the snowblower. For example, a joystick type control handle can be provided to control the deflector. In known joystick designs of this type, however, the operation of the joystick generally involves complex mechanical systems, such as electric motors, multiple cables for different directions of pivoting, complex linkages, and/or gear systems. These features can raise the cost to manufacture and sell the snowblower. Such complex mechanical systems can also introduce multiple possible failure modes, especially in the extremely cold conditions in which snowblowers are often operated and stored.

As a result, it would be desirable for a snowblower adjustable deflector control device, system, and method to be durable, reliable, and simple to use while still providing effective operation of the snowblower chute.

SUMMARY

In accordance with this disclosure, snowblower adjustable deflector control devices, systems, and methods are provided. In one aspect, an adjustable snowblower deflector control system is provided. The system can comprise a control cable connected at one end to a movable deflector of a discharge chute of a snowblower, a control lever pivotably connected to a machine handle of the snowblower, and a lever guide connected to the machine handle. The control lever can comprise a first end comprising a grip portion, a second end connected to the control cable, and at least one protrusion extending from the control lever, and the lever guide can be configured to selectively retain the at least one protrusion in any of one or more angular positions corresponding to one or more deflector positions.

In another aspect, an adjustable snowblower deflector control system is provided. The system according to this aspect can comprise a control cable connected at one end to a movable deflector of a discharge chute of a snowblower such that tension on the control cable pulls the movable deflector towards a relatively lower-angle position. A biasing element can be connected between the movable deflector and the discharge chute, the biasing element being configured to urge the movable deflector towards a relatively higher-angle position. A control lever comprising a first end comprising a grip portion, a second end connected to the control cable, and at least one protrusion extending from the control lever can be pivotably connected to a machine handle of the snowblower at a pivot point positioned between the first end and the second end. Finally, a lever guide can be connected to the machine handle, the lever guide comprising a plurality of openings configured for receiving the at least one protrusion to selectively retain the at least one protrusion in any of one or more angular positions corresponding to one or more deflector positions, wherein the control lever is movable away from the lever guide such that the at least one protrusion is movable out of engagement with the plurality of openings.

In yet another aspect a method for adjusting the position of an adjustable snowblower deflector is provided. The method can comprise, for a control lever pivotably connected to a machine handle of a snowblower and positioned adjacent to and selectively engageable with a lever guide connected to the machine handle, tilting the control lever away from the lever guide to disengage the control lever from the lever guide. The control lever can be pivoted relative to the lever guide to move a control cable connected to a movable deflector of a discharge chute of a snowblower, wherein pivoting the control lever causes the movable deflector to pivot relative to the discharge chute. The control lever can be tilted towards the lever guide to engage the control lever with the lever guide.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
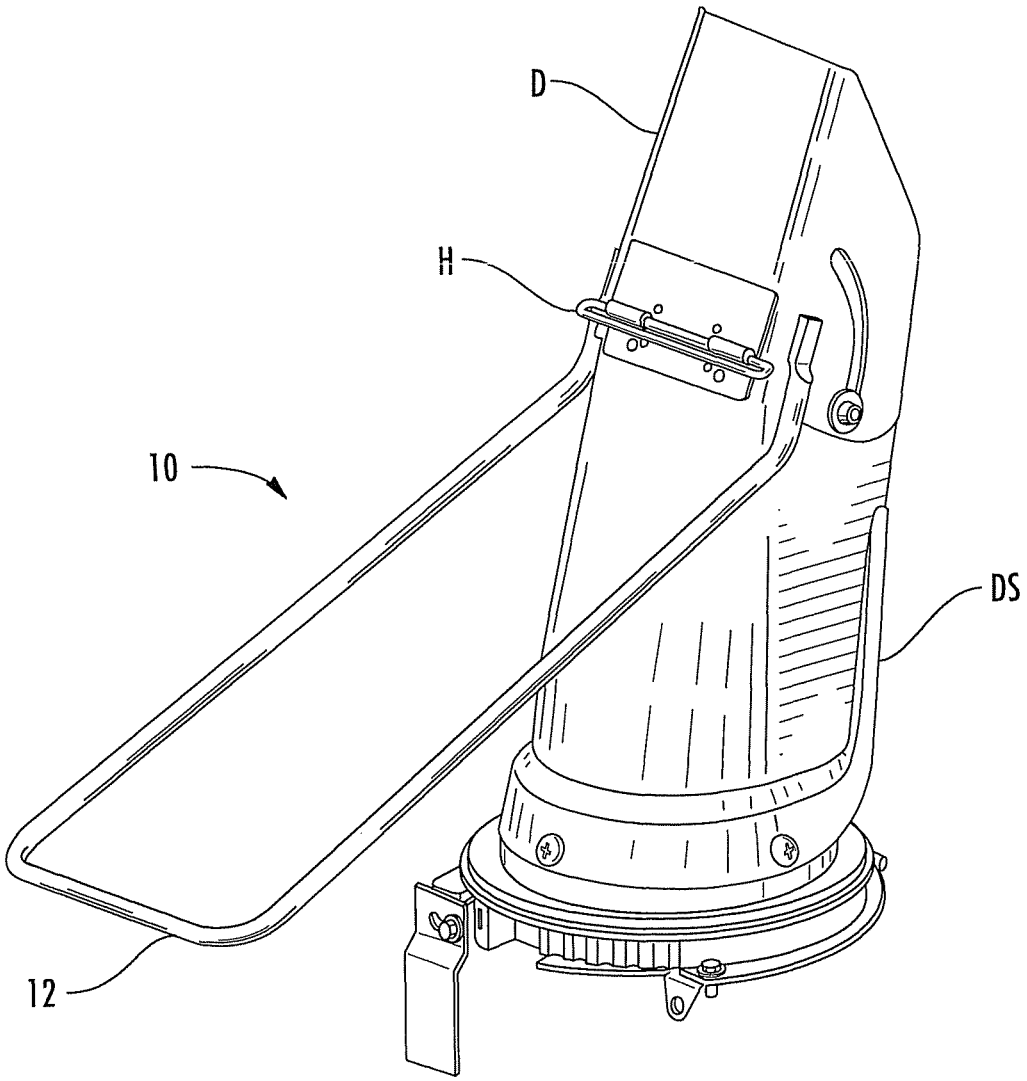
FIG. 1 (PRIOR ART)
FIG. 1 is a perspective view of a snowblower adjustable deflector control system according to a conventional configuration.
Figure 2A:
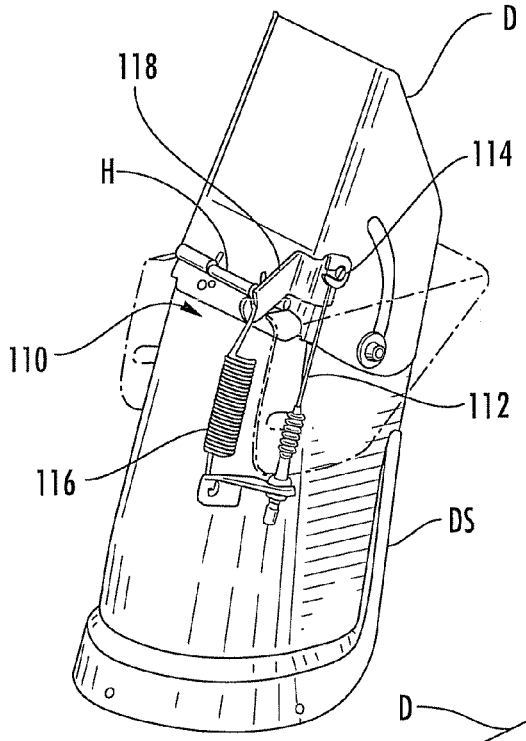
FIG. 2A is a perspective view of a deflector coupled to a snowblower adjustable deflector control system according to an embodiment of the presently disclosed subject matter.
Figure 2B:
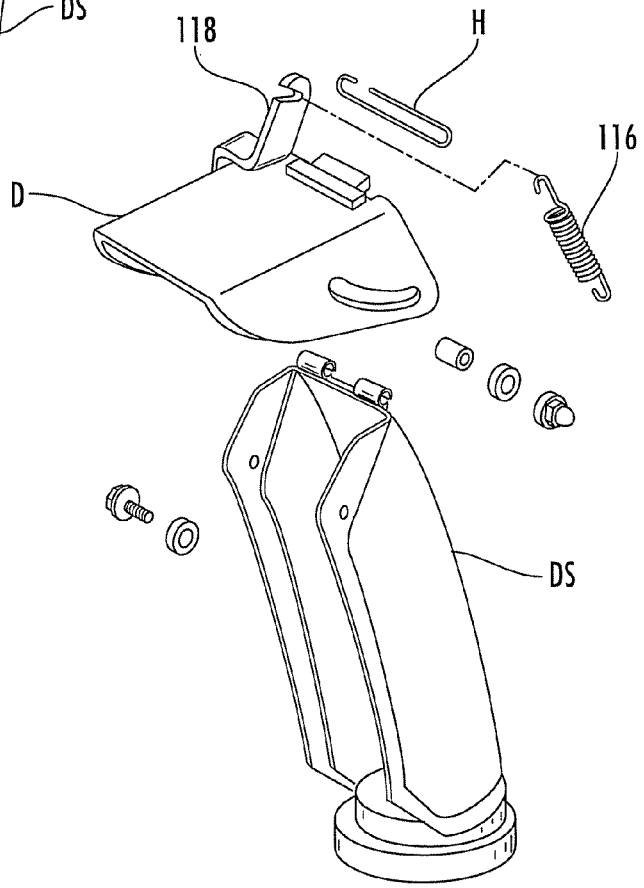
FIG. 2B is an exploded perspective view of a deflector coupled to a snowblower adjustable deflector control system according to an embodiment of the presently disclosed subject matter.

The present subject matter provides adjustable deflector control devices, systems, and methods for use with a snowblower. In one aspect, the present subject matter provides an adjustable snowblower deflector control system. Referring to FIGS. 2A and 2B, for example, for a pivotable deflector D connected to a discharge chute DS at a hinged connection H, the system can comprise a deflector position control, generally designated 110, which can include a control cable 112 connected at one end to deflector D. For instance, as shown in FIGS. 2A and 2B, deflector position control 110 can comprise a deflector cable connector 114 secured to a portion of movable deflector D. Control cable 112 can be a Bowden cable (i.e., an inner cable that is movable relative to a hollow outer cable housing) such as those that are commonly used in the art. Control cable 112 can be connected at one end to deflector cable connector 114 such that tension on control cable 112 acts to pull deflector D towards a relatively lower-angle position. (See, e.g., position of deflector D shown in shadow in FIG. 2A.)

To allow actuation of control cable 112 to cause this movement of deflector D, deflector cable connector 114 can be specifically positioned on deflector D to be forward of hinge H such that actuating control cable 112 (I.e., applying tension) exerts a downwardly-directed force on deflector D, thereby causing deflector D to pivot in a downward direction about hinge H, which can be desirable for directing snow output from discharge chute DS in a substantially outward direction. To move deflector D towards a relatively higher-angle position, a biasing element 116 can further be attached to deflector D. For example, as shown in FIG. 2A, biasing element 116 can be connected between deflector D and discharge chute DS in such a way that a force is applied that tends to pull deflector D in a substantially upward direction (i.e., deflector D extended relative to discharge chute DS), which can be desirable for directing snow output from discharge chute DS in a more upward direction.

In particular, for example, hinge H can itself be spring-loaded such that deflector D is biased towards an extended position relative to discharge chute DS. Alternatively, in the configuration shown in FIGS. 2A and 2B, for example, biasing element 116 can be a spring that is connected at one end to discharge chute DS and at the other end to a pivot arm 118 that is connected to deflector D. Pivot arm 118 can extend from deflector D in a direction relative to hinge H that is substantially opposite to the direction that deflector cable connector 114 extends relative to hinge H. As further shown in FIGS. 2A and 2B, pivot arm 118 and deflector cable connector 114 can be provided on a single bracket that can be attached to deflector D, which can enable relatively quicker and easier manufacture and/or modification of existing snowblower chute assemblies.

Regardless of the specific configuration, however, the interaction of biasing element 116 with deflector D can be designed such that the force exerted by biasing element 116 acts in an opposite direction to the force exerted by the actuation of control cable 112. Specifically, biasing element 116 can be designed to be in an unloaded state (i.e., exerting no force) when deflector D is positioned in a highest desired angle of inclination (e.g., a fully extended position), but biasing element 116 can exert a force on deflector D whenever deflector D is pivoted to a relatively lower angle position. Alternatively, biasing element 116 can be configured to always exert a force on deflector D, but the connection of deflector D to discharge chute DS can include a stop that prevents deflector D from pivoting beyond a highest desired angle of inclination (i.e., prevent over-rotating). Of course, it should be recognized that the relative movement of deflector D by control cable 112 and biasing element 116, respectively, can be inverted such that operation of control cable 112 moves deflector D towards an upward-facing angular position and biasing element 116 acts to bias deflector D towards an outward-facing angular position.

In any configuration, selective operation of a single actuator (i.e., control cable 112) can allow the user to effect bi-directional movement of deflector D. In particular, when it is desired to lower the angle of inclination of deflector D (or increase the angle in an inverted configuration), control cable 112 can be actuated to exert a relatively downward-directed force on deflector D. If the force of this actuation is greater than the biasing force exerted by biasing element 116, deflector D can move in a relatively downward direction. Alternatively, when it is desired to increase the angle of inclination of deflector D (or decrease the angle in an inverted configuration), the tension applied by way of control cable 112 can be relaxed, thereby allowing the biasing force applied by biasing element 116 to pull deflector back towards a higher-angle position.

Figure 3:
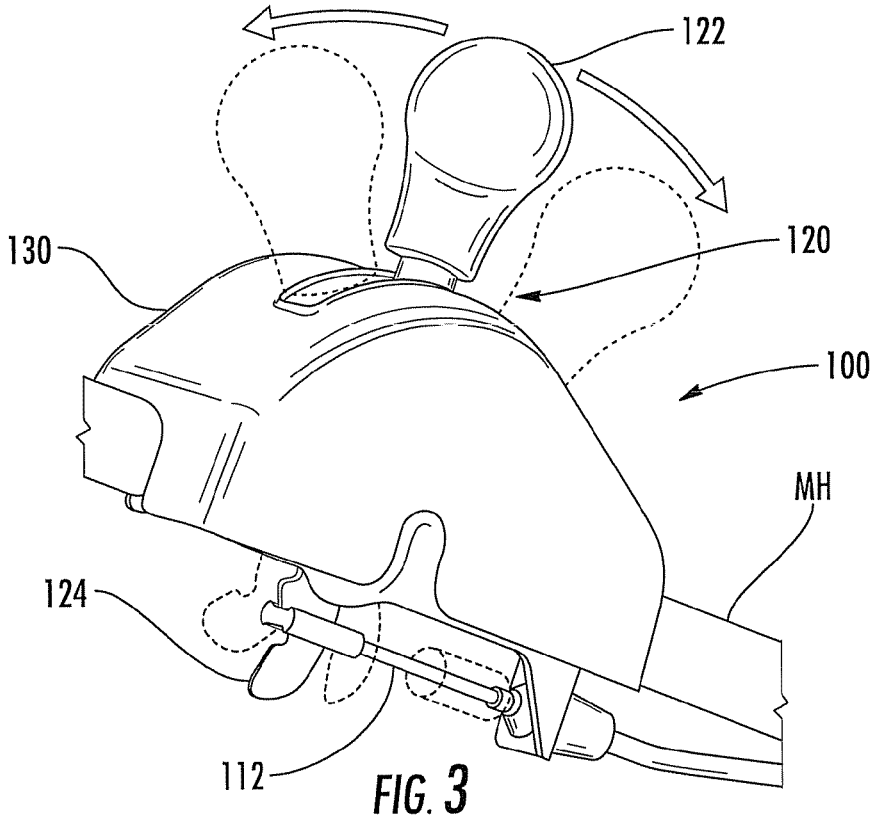
FIG. 3 is a perspective view of a control handle for a snowblower adjustable deflector control system according to an embodiment of the presently disclosed subject matter.

To control this selective actuation of control cable 112, a deflector control system, generally designated 100, can be provided in a position that is easily accessible to the operator of the snowblower. Referring to FIG. 3, for example, deflector control system 100 can comprise a control lever, generally designated 120, that is pivotably attached to a machine handle MH of the snowblower. Control lever 120 can comprise a first end comprising a grip portion 122 and a second end comprising a lever cable connector 124 connected to control cable 112. A protective housing 130 can substantially surround control lever 120 and its connected components, with grip portion 122 extending through a slot in housing 130. In this way, the inner working mechanisms of deflector control system 100 can be shielded from intentional or inadvertent damage, and the operator can be protected from being pinched or otherwise injured by exposed mechanical elements.

Figure 4A:
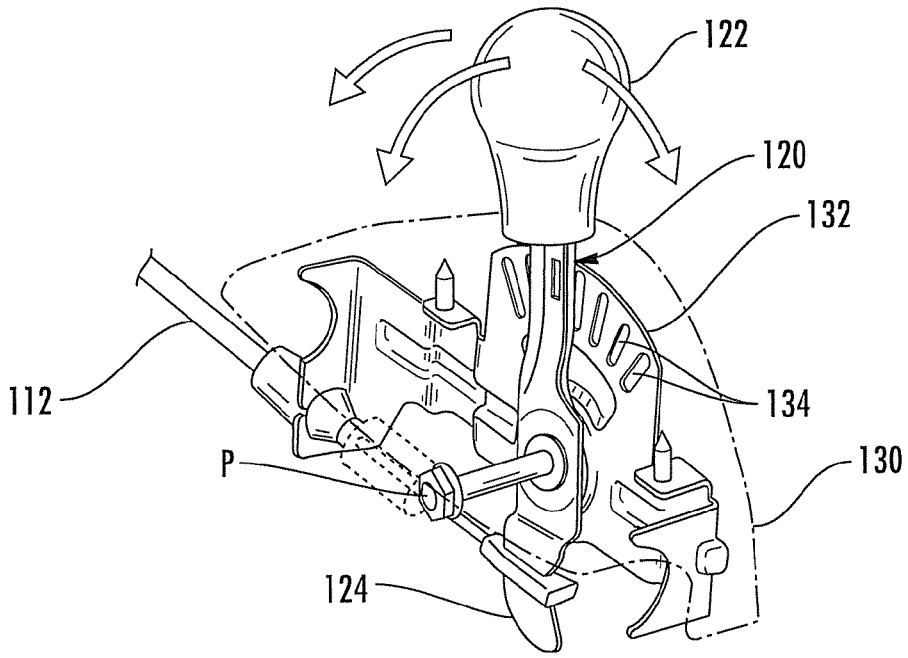
FIG. 4A is a perspective view of a control handle for a snowblower adjustable deflector control system with a protective housing removed according to an embodiment of the presently disclosed subject matter.

Regarding the mechanical operation of deflector control system 100, in the configuration shown in FIG. 3, control lever 120 can be attached to machine handle MH such that movement of grip portion 122 in a first direction causes lever cable connector 124 to move in second direction substantially opposing the first direction. As shown in FIG. 4A, for example, control lever 120 can be pivotably connected to machine handle MH at a pivot point P that is positioned between the first end and the second end (i.e., between grip portion 122 and lever cable connector 124). In this way, movement of grip portion 122 in a forward direction (i.e., towards discharge chute DS; to the right of FIG. 3) can cause lever cable connector 124 to move in a backward direction (i.e., away from discharge chute DS; to the left of FIG. 3), which can in turn exert a force on control cable 112 to result in movement of deflector D to a relatively lower angle of inclination. Accordingly, in this configuration, operation of deflector control system 100 can be relatively intuitive for the operator, with forward movements of grip portion 122 causing downward pivoting of deflector D, and backward movements of grip portion causing upward pivoting of deflector D. Those having ordinary skill in the art will recognize, however, that other arrangements and connections of the elements described hereinabove can likewise result in simple-to-use but effective operation of the snowblower chute.

Regardless of the specific configuration, the angular position of deflector D can be controlled by balancing of the force exerted by control cable 112 against the biasing force exerted by biasing element 116. Where biasing element 116 is a spring, for example, it will exert a biasing force that urges deflector towards a relatively higher-angle position as long as deflector D is pivoted downward from a fully-extended "base" position (e.g., biasing element 116 in an unloaded state). Deflector control system 100 can be configured to maintain control lever 120 in place once grip portion 122 is moved to a position corresponding to a desired operating angle for deflector D without requiring the operator to hold grip portion 122 in the desired position.

Figure 4B:
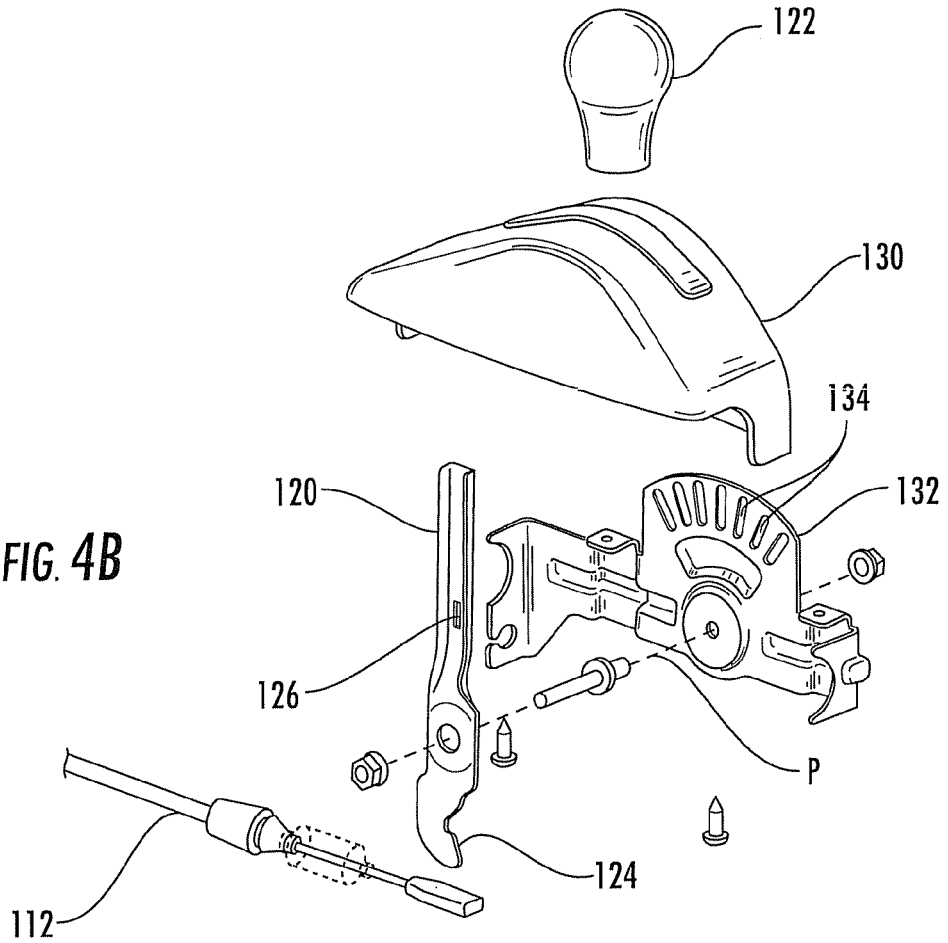
FIG. 4B is an exploded perspective view of a control handle for a snowblower adjustable deflector control system according to an embodiment of the presently disclosed subject matter.
Figure 5A:
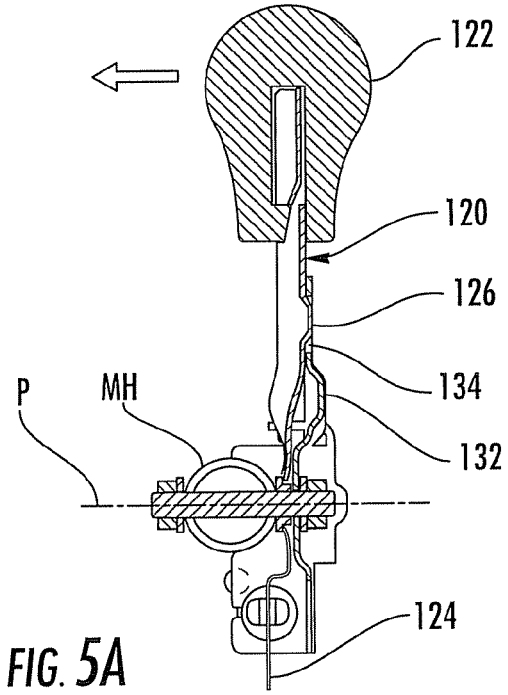
FIG. 5A is a side sectional view of a control handle for a snowblower adjustable deflector control system according to an embodiment of the presently disclosed subject matter.

In this regard, as shown in FIGS. 4A and 4B, deflector control system 100 can comprise a lever guide 132 connected to machine handle MH and configured to selectively retain control lever 120 in a desired position. For example, as illustrated in FIGS. 4A, 4B, and 5A, control lever 120 can comprise at least one protrusion 126 extending from its side, and lever guide 132 can be positioned near to the side of control lever 120 from which protrusion 126 extends. Lever guide 132 can further be configured to selectively retain protrusion 126 in any of one or more angular positions corresponding to one or more angular position of deflector D. Specifically, lever guide 132 can comprise a plurality of openings 134 that are each configured for receiving protrusion 126. In particular, for example, in the configuration shown in FIGS. 4A and 4B, lever guide 132 can be a rigid plate that is positioned substantially parallel to a plane through which control lever 120 is pivotable relative to machine handle MH. As discussed above, lever guide 132 can have a plurality of openings 134 (e.g., seven openings are shown in FIGS. 4A and 4B) that are spaced apart from each other and are configured for receiving protrusion 126.

In this configuration, when control lever 120 is positioned with protrusion 126 aligned with one of openings 134, lever guide 132 can restrain control lever 120 from pivoting relative to machine handle MH, thereby maintaining control lever 120 in one of a discrete number of predetermined angular positions corresponding to discrete angular operating positions of deflector D, which can maintain control cable 112 at a corresponding tension associated with a discrete angular position of deflector D. The number of openings 134 can be as few or as many as desired to define the angular positions to which deflector D can be moved for operation of the snowblower. For example, as few as two of openings 134 can be provided to simply define one "high angle" position and one "low angle" position, or many more of openings 134 can be provided to define a wider range of discrete positioning options for the user to select.

In any configuration, although lever guide 132 can securely engage protrusion 126 to prevent control lever 120 from pivoting out of a desired angular position, control lever 120 can be configured such that it can be easily moved from one position to another when desired. In this regard, control lever 120 can be designed to not only pivot relative machine handle to cause selective actuation of control cable 112, but control lever 120 can further be configured to tilt or flex in a direction substantially perpendicular to the plane through which it pivots (i.e., away from lever guide 132) to pull projection 126 out of engagement with a selected one of openings 134, at which point control lever 120 can be pivoted relative to machine handle MH into alignment with another of openings 134 corresponding to a next desired operating position of deflector D.

This out-of-plane movement of control lever 120 can be achieved by forming control lever 120 from a durable yet relatively flexible material (e.g., spring steel) such that a small deflection of at least a portion of control lever 120 (e.g., the top portion containing grip portion 122) can pull projection 126 out of engagement with a selected one of openings 134. Where control lever 120 comprises a flexible material as noted above, this small deflection can be a substantially elastic bending such that once control lever 120 is positioned at a desired angle, the flexible material can cause control lever 120 to spring back towards lever guide 132. Alternatively, control lever 120 can be hinged or otherwise configured to tilt in an out-of-plane direction out of and into engagement with lever guide 132. In such a configuration, an additional biasing element can be provided to urge control lever 120 towards engagement with lever guide 132 (i.e., urging protrusion 126 into engagement with one of openings 134).

In any configuration, control lever 120 can be tilted/flexed about a point between pivot point P and grip portion 122 such that, although first end can be pulled away from lever guide 132 to disengage protrusion 126 from openings 134, control lever 120 can still be firmly connected to machine handle MH at pivot point P, thereby giving an operator a feeling of sturdy construction. In other words, although the first portion of control lever 120 can be moved laterally relative to the plane about which it is pivotable, there need not be any "play" in the pivoting connection of control lever 120 to machine handle MH.

Figure 5B:
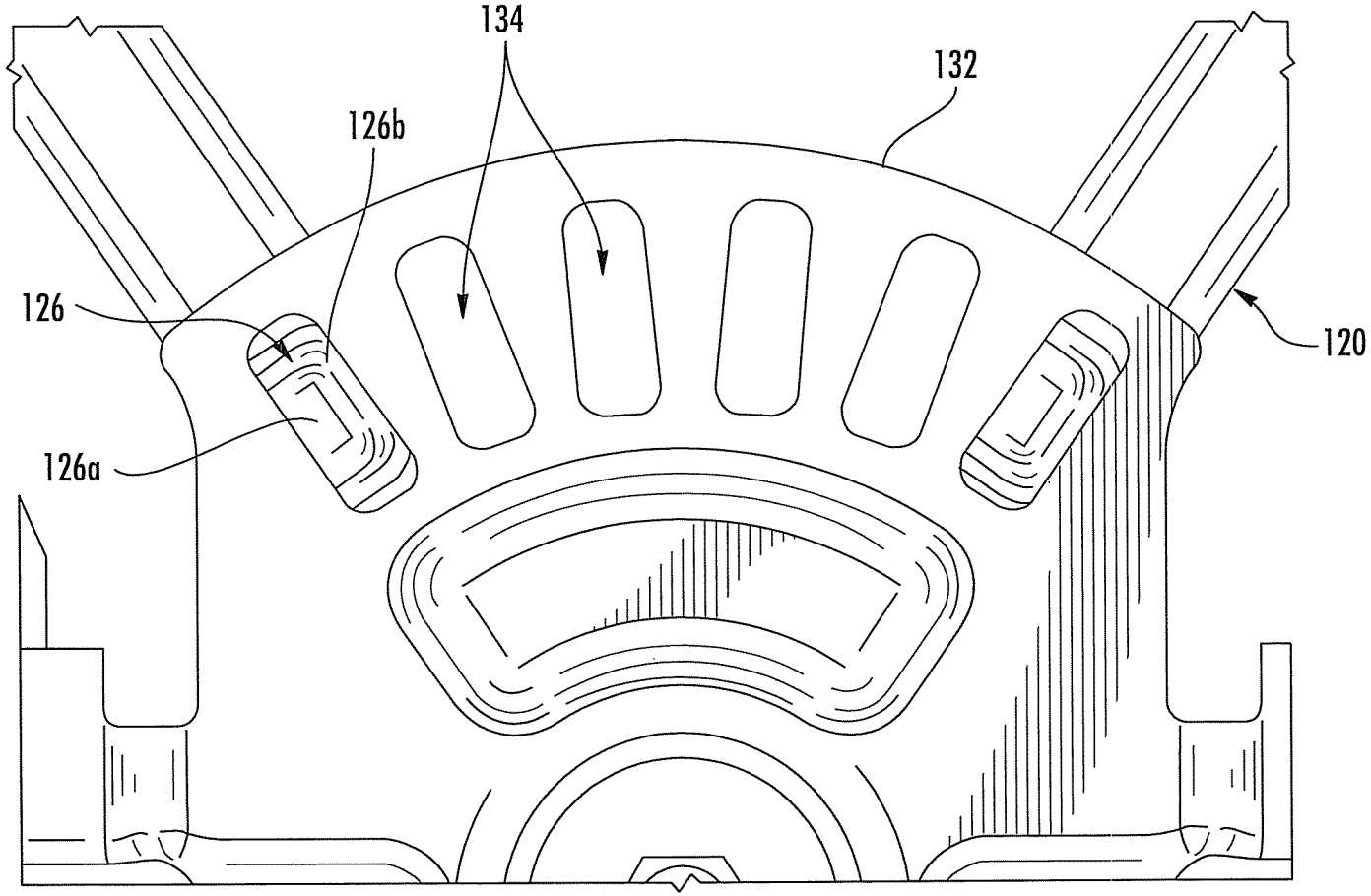
FIG. 5B is a side view of a guide plate of a snowblower adjustable deflector control system according to an embodiment of the presently disclosed subject matter.

Furthermore, protrusion 126 can itself be specifically designed to control the way in which control lever 120 can be moved relative to lever guide 132. Specifically, for example, as shown in FIG. 5B, protrusion 126 can comprise different edge configurations that can be selected to either assist or constrain the process of moving between predetermined angular positions. In a first configuration, protrusion 126 can comprise at least one defined edge 126*a* that can serve as an abutment to engage an inner edge of a respective one of openings 134 and thereby prevent control lever 120 from pivoting relative to lever guide 132 unless it is tilted/flexed such that protrusion 126 is moved out of opening 134.

Alternatively, one or more edges of protrusion 126 can define a cam surface 126*b* that is curved or otherwise sloped such that when a force is exerted on control lever 120 that pushes cam surface 126*b* against an inner edge of a respective one of openings 134, cam surface 126*b* urges control lever 120 away from lever guide 132. In this way, control lever 120 need not be affirmatively tilted away from lever guide 132 by the operator. Rather, simply pivoting control lever 120 in the desired direction can cause protrusion 126 to slip out of engagement with a respective one of openings 134, thereby allowing control lever 120 to be pivoted relative to machine handle MH and lever guide 132, and protrusion 126 can snap into engagement with the next of openings 134 once control lever 120 has pivoted the incremental distance between openings.

In the specific configuration shown in FIG. 5B, these different edge formations can be provided on opposing edges of protrusion 126 to allow control lever 120 to easily snap between successive angular positions when pivoting in one direction but requiring the operator to more actively disengage control lever 120 from lever guide 132 when pivoting control lever 120 in the opposite direction. For example, where deflector D is biased towards a high-angle position (i.e., upward snow discharge) using biasing element 116, defined edge 126*a* can be provided on an edge of protrusion 126 that faces the direction of pivoting that corresponds to upward movement of deflector D (i.e., the direction towards which control lever 120 is pivoted to cause upward rotation of deflector D). In this way, the biasing force exerted by biasing element 116 cannot act to change the position of control lever 120 without user assistance. In contrast, cam surface 126*b* can be provided on an edge of protrusion 126 that faces the direction of pivoting that corresponds to downward movement of deflector D (i.e., the direction towards which control lever 120 is pivoted to cause downward rotation of deflector D). In this way, to pivot deflector D in a direction against the biasing force of biasing element 116, the user can simply push control lever 120 in the desired direction and let cam surface 126*b* initiate the disengagement of protrusion 126 from the respective one of openings 134.

This written description uses examples to disclose the subject matter, including the best mode, and also to enable any person skilled in the art to make and use the subject matter herein. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An adjustable snowblower deflector control system comprising:

a control cable connected at one end to a movable deflector of a discharge chute of a snowblower;

a control lever pivotably connected to a machine handle of the snowblower, the control lever comprising a first end comprising a grip portion, a second end connected to the control cable, and at least one protrusion extending from the control lever; and a lever guide connected to the machine handle, the lever guide comprising a plurality of openings configured for receiving the at least one protrusion, wherein the lever guide is configured to selectively retain the at least one protrusion in any of one or more angular positions corresponding to one or more deflector positions;

wherein the control lever is movable away from the lever guide such that the at least one protrusion is movable out of engagement with the lever guide; and wherein the at least one protrusion comprises a cam surface on one edge of the at least one protrusion, the cam surface configured for urging the control lever away from the lever guide when a force exerted on the control lever pushes the cam surface against an edge of a respective one of the plurality of openings.

2. The adjustable snowblower deflector control system of claim 1, wherein the control lever is pivotably connected to the machine handle at a pivot point positioned between the first end and the second end.

3. The adjustable snowblower deflector control system of claim 1, wherein the control lever is pivotable relative to the machine handle in a plane substantially parallel to the lever guide.

4. The adjustable snowblower deflector control system of claim 1, wherein the control lever comprises a flexible material, and wherein the control lever is movable away from the lever guide by elastically flexing at least a portion of the control lever away from the lever guide.

5. The adjustable snowblower deflector control system of claim 4, wherein the control lever comprises spring steel.

6. The adjustable snowblower deflector control system of claim 1, wherein the control lever is biased towards the lever guide.

7. The adjustable snowblower deflector control system of claim 1, comprising a biasing element connected to the movable deflector;

wherein the control cable is configured such that tension on the control cable pulls the movable deflector towards a relatively lower-angle position; and wherein the biasing element is configured to urge the movable deflector towards a relatively higher-angle position.

8. The adjustable snowblower deflector control system of claim 7, wherein the biasing element comprises a spring.

9. The adjustable snowblower deflector control system of claim 1, comprising a housing substantially surrounding the lever guide, the housing comprising a slot through which the first end extends.

10. The adjustable snowblower deflector control system of claim 1, wherein the at least one protrusion comprises a defined edge on an edge of the at least one protrusion substantially opposing the cam surface, the defined edge configured to prevent the control lever from pivoting relative to the lever guide in a direction towards which the defined edge faces unless it is moved out of engagement with the lever guide.

11. An adjustable snowblower deflector control system comprising:

a control cable connected at one end to a movable deflector of a discharge chute of a snowblower such that tension on the control cable pulls the movable deflector towards a relatively lower-angle position;

a biasing element connected between the movable deflector and the discharge chute, the biasing element being configured to urge the movable deflector towards a relatively higher-angle position;

a control lever comprising a first end comprising a grip portion, a second end connected to the control cable, and at least one protrusion extending from the control lever, the control lever being pivotably connected to a machine handle of the snowblower at a pivot point positioned between the first end and the second end; and a lever guide connected to the machine handle, the lever guide comprising a plurality of openings configured for receiving the at least one protrusion to selectively retain the at least one protrusion in any of one or more angular positions corresponding to one or more deflector positions;

wherein the control lever is movable away from the lever guide such that the at least one protrusion is movable out of engagement with the plurality of openings; and wherein the at least one protrusion comprises a cam surface on one edge of the at least one protrusion, the cam surface configured for urging the control lever away from the lever guide when a force exerted on the control lever pushes the cam surface against an edge of a respective one of the plurality of openings.

12. The adjustable snowblower deflector control system of claim 11, wherein the at least one protrusion comprises a defined edge on an edge of the at least one protrusion substantially opposing the cam surface, the defined edge configured to prevent the control lever from pivoting relative to the lever guide in a direction towards which the defined edge faces unless it is moved out of engagement with the plurality of openings.

13. A method for adjusting a position of an adjustable snowblower deflector, the method comprising:

for a control lever pivotably connected to a machine handle of a snowblower and positioned adjacent to and selectively engageable with a lever guide connected to the machine handle, wherein the control lever comprises at least one protrusion extending from the control lever and configured to be selectively retained by the lever guide, tilting the control lever away from the lever guide to move the protrusion out of engagement with the lever guide and disengage the control lever from the lever guide;

pivoting the control lever relative to the lever guide to move a control cable connected to a movable deflector of a discharge chute of a snowblower, wherein pivoting the control lever causes the movable deflector to pivot relative to the discharge chute; and tilting the control lever towards the lever guide to engage the control lever with the lever guide;

wherein the at least one protrusion comprises a cam surface on one edge of the at least one protrusion, wherein tilting the control lever away from the lever guide comprises exerting a force on the control lever to push the cam surface against the lever guide such that the cam surface urges the control lever away from the lever guide.

14. The method of claim 13, wherein tilting the control lever towards the lever guide comprises retaining the at least one protrusion in any of one or more angular positions corresponding to one or more deflector positions.

15. The method of claim 14, wherein retaining the at least one protrusion in any of one or more angular positions comprises engaging the at least one protrusion with one of a plurality of openings in the lever guide.

16. The method of claim 15, wherein exerting a force on the control lever to push the cam surface against the lever guide comprises exerting a force on the control lever to push the cam surface against an edge of a respective one of the plurality of openings such that the cam surface urges the control lever away from the lever guide.

17. The method of claim 13, wherein pivoting the control lever comprises pivoting the control lever in a plane substantially parallel to the lever guide.

18. The method of claim 13, wherein the control lever comprises a flexible material, wherein tilting the control lever away from the lever guide comprises elastically flexing at least a portion of the control lever away from the lever guide.

19. The method of claim 18, wherein the control lever is biased towards the lever guide by a biasing force generated by bending of the flexible material, wherein tilting the control lever towards the lever guide comprises allowing the biasing force to move the control lever towards the lever guide.

* * * * *